United States Patent [19]

Harandi et al.

[11] Patent Number: 5,049,360

[45] Date of Patent: Sep. 17, 1991

[54] MULTI-STAGE CONVERSION OF ALKANES TO GASOLINE

[75] Inventors: Mohsen N. Harandi, Lawrenceville; Hartley Owen, Belle Mead, both of N.J.

[73] Assignee: Mobil Oil Corporation, Fairfax, Va.

[21] Appl. No.: 358,096

[22] Filed: May 30, 1989

Related U.S. Application Data

[63] Continuation-in-part of Ser. No. 144,991, Jan. 19, 1988, Pat. No. 4,859,308.

[51] Int. Cl.[5] ..... F27B 15/00; F27B 15/16; B01J 8/18

[52] U.S. Cl. ..... 422/141; 422/145; 422/146

[58] Field of Search ..... 422/141, 144, 146; 585/431, 533, 415, 417

[56] References Cited

U.S. PATENT DOCUMENTS

| | | | |
|---|---|---|---|
| 4,675,461 | 6/1987 | Owen et al. | 585/415 X |
| 4,840,928 | 6/1989 | Harandi et al. | 585/666 X |
| 4,859,308 | 8/1989 | Harandi et al. | 585/431 X |
| 4,912,273 | 3/1990 | Harandi et al. | 585/415 X |

*Primary Examiner*—Robert J. Warden
*Assistant Examiner*—Amalia L. Santiago
*Attorney, Agent, or Firm*—Alexander J. McKillop; Charles J. Speciale; L. G. Wise

[57] ABSTRACT

An improved reactor system for hydrocarbon processing, employing an external catalyst cooler ("ECC") for dehydrogenating and cracking an alkane stream by contacting it with a fluid catalytic cracking ("FCC") catalyst to produce olefins. Advantageously, these olefins are then oligomerized to gasoline in a single zone of a fluid bed crystalline zeolite oligomerization catalyst, the bed operating in the turbulent regime.

2 Claims, 1 Drawing Sheet

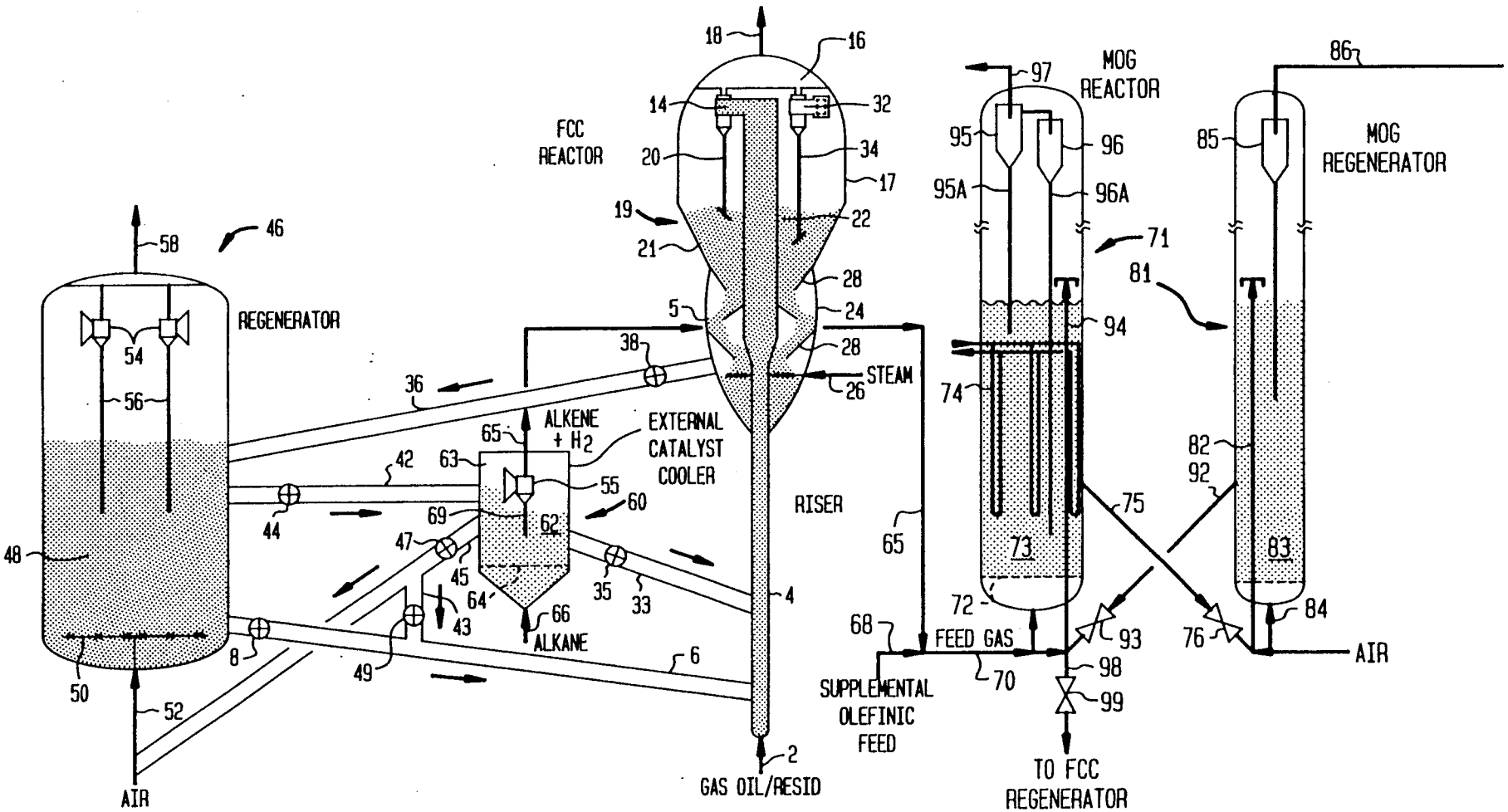
MOG REGENERATOR
MOG REACTOR
FCC REACTOR
REGENERATOR
EXTERNAL CATALYST COOLER
RISER
STEAM
FEED GAS
SUPPLEMENTAL OLEFINIC FEED
TO FCC REGENERATOR
GAS OIL/RESID
AIR
ALKENE + H2
ALKANE

MULTI-STAGE CONVERSION OF ALKANES TO GASOLINE

REFERENCE TO COPENDING APPLICATION

This application is a continuation-in-part of U.S. patent application Ser. No. 144,991 filed Jan. 19, 1988, now U.S. Pat. No. 4,859,308 issued Aug. 22, 1989 incorporated herein by reference.

BACKGROUND OF THE INVENTION

This invention relates to an improved reactor system for cracking and upgrading hydrocarbons.

Catalyst from a fluidized catalytic cracker ("FCC") unit is regenerated in a FCC regenerator operating at high temperature due to the high heat release of burning coke. Hot regenerated catalyst (regen catalyst) is conventionally cooled in a catalyst cooler ("catcooler") by generating steam. The catcooler may be either internal or external. In the present invention, regen catalyst in an external catalyst cooler ("ECC"), which also functions as a dehydrogenation reactor to which the alkanes are fed. Coupling the dehydrogenation of $C_2$+ alkanes, and particularly a lower $C_2$–$C_6$ alkane, preferably a mixture of propane ($C_3$) and butane ($C_4$) containing a minor amount by weight of olefins and $C_5$+ alkanes, in the ECC, with the operation of a FCC regenerator is described in greater detail in copending patent application Ser. No. 144,991 filed Jan. 19, 1988, incorporated by reference. FCC regenerators are designed to be not-operated under pressure, that is, operated at a pressure in the range from about 25 psig to 40 psig, and as high a temperature as is practical from a materials standpoint. The temperature within a FCC regenerator typically ranges from about 538° C. to about 815° C. (1000°–1500° F.) and the ECC operates in our process, in the same general range of pressure and temperature.

Because the dehydrogenation reaction is partly pyrolytic and partly catalytic (effect of the FCC catalyst), the catalyst is referred to as "dehydrogenation catalyst" or "ECC catalyst" when it is in the ECC, and we refer to the catalyst as "regen catalyst" when it is being regenerated. The thermal dehydrogenation of normally liquid hydrocarbons at a temperature in the range from 538° C. to 750° C. (1000°–1382° F.) by pyrolysis in the presence of steam, is disclosed in U.S. Pat. Nos. 3,835,029 and 4,172,816, inter alia, but there is no suggestion that such a reaction may be used as the basis for direct heat exchange, to cool regen catalyst in an ECC for a FCC unit, and provide a mixture of alkenes (or olefins, mainly mono-olefins) and alkanes (paraffins) in the ECC's effluent, as we have done for the first stage of our two-stage process.

The desirability of upgrading lower alkanes to gasoline, distillate and lubes has long been recognized and U.S. Pat. No. 4,542,247 discloses a process for doing so, requiring two oligomerization zones and separation of the effluent from each, to recover the gasoline values.

The oligomerization of lower olefins, alone or in a mixture with alkanes over a ZSM-5 type catalyst having controlled acidity has been disclosed in U.S. Pat. Nos. 3,960,978 and 4,021,502 to Plank et al., and improvements have been disclosed by Garwood et al. in U.S. Pat. Nos. 4,150,062; 4,211,640; and 4,227,992, incorporated by reference.

Oligomerization to gasoline range hydrocarbons ("gasoline" for brevity) is sometimes referred to as the Mobil Olefin to Gasoline, or MOG process, and in the prior art is preferably conducted over HZSM-5 at moderately elevated pressure and temperature in the ranges from about 6869 kPa (100 psia) to about 3445 kPa (500 psia), and from about 300° C. to about 500° C., respectively. The MOG reactor herein also operates in the same temperature range, but preferably at a pressure lower than 689 kPa (100 psia), for example about 275 kPa (40 psia).

The prior art did not recognize that, particularly for the production of gasoline range hydrocarbons from lower olefins, there would be a great economic advantage if the olefins could be obtained at the proper oligomerization temperature, substantially without cost, and could be oligomerized at relatively lower pressure than previously thought desirable. Since, in the real-life operation of a refinery, lower olefins, and especially $C_4$=+ (butenes, and higher) are valuable for alkylation, etc., it is only particular economic circumstances which justify their use in a MOG unit. The capability of generating these olefins in the ECC without the inefficiencies of conventional indirect regen catalyst cooling provides an unexpected economic impetus to our two-stage process, at the same time providing a source of olefins for other refinery needs.

Further, in this two-stage process, the first stage will also convert light straght run ($C_5$ and $C_6$) alkanes, and ($C_5$ paraffinic raffinate (such as Udex® raffinate) to olefins because the conversion of all available $C_3$+ alkanes proceeds with excellent yields at essentially the same process operating conditions of the ECC.

A still further benefit of tying the operation of the MOG reactor to the ECC and the FCC unit is that a portion of the spent catalyst from the regenerator for MOG reactor may be withdrawn and introduced into the FCC cracker, instead of being discarded. In this manner, the activity of the MOG catalyst in the MOG reactor may be maintained at the desired optimum, and the otherwise-discarded catalyst functions as an effective catalytic cracking octane enhancer additive.

SUMMARY OF THE INVENTION

An external catalyst cooler ("ECC") can be employed for dehydrogenating and cracking an alkane stream by contacting it with a fluid catalytic cracking ("FCC") catalyst to produce olefins; the olefins are then oligomerized to gasoline in a single zone of a fluid bed crystalline zeolite oligomerization catalyst, the bed operating in the turbulent regime. The present invention relates to an improvement in facilities for converting alkanes into gasoline, wherein the facility includes a fluid catalytic cracking system and an olefin oligomerization reactor operatively connected for upgrading FCC olefins recovered from cracking effluent. The FCC unit includes a first regenerator means for regenerating a coke-contaminated fluid cracking catalyst in a first regeneration zone at a pressure in the range from above 20 psig to about 50 psig and a temperature in the range from about 650° C. to 790° C. (about 1200°–1450° F.), while injecting said first regenerator zone with enough oxygen-containing regeneration gas to maintain a dense fluid bed of cracking catalyst in said first regenerator zone so as to regenerate the catalyst before returning it to a fluid cracker.

The oligomerization unit includes an oligomerization reactor and a second regenerator means for regenerating a coke-contaminated oligomerization catalyst in a second regeneration zone while injecting said second regenerator zone with enough oxygen-containing regeneration gas to maintain a dense fluid bed of oligomerization catalyst in said second regenerator zone so as to regenerate said oligomerization catalyst before returning it to said oligomerization reactor.

The improvement herein comprises: first valved conduit means for withdrawing a controlled stream of said regenerator catalyst from said regenerator; a dehydrogenation reactor in valved communication with said regenerator, said dehydrogenation reactor having a dehydrogenation zone at a temperature below those prevailing in said first regeneration zone, said dehydrogenation reactor being located externally relative to said cracker and regenerator; means for introducing a lower alkane feedstream into said dehydrogenation zone in an amount sufficient to maintain hot withdrawn catalyst in a state of fluidization in said dehydrogenation reactor while said catalyst is being cooled; a second valved conduit means for transporting cooled catalyst from said dehydrogenation zone to said first regeneration zone; a third conduit means for withdrawing an olefinic effluent stream from said dehydrogenation reactor and flowing said effluent to, said oligomerization reactor containing a medium pore zeolite catalyst effective to oligomerize olefins in said effluent to gasoline at superatmospheric pressure and temperature in the range from about 315° C. to about 538° C., said second regenerator means being in valved communication with said oligomerization reactor said second regenerator means having a second regeneration zone operating at a pressure lower than that in said oligomerization reactor, and a temperature in the range from about 370° C. to about 538° C.; fourth valved conduit means for transporting regenerated oligomerization catalyst from said second regeneration zone to said oligomerization reactor; and fifth conduit means for withdrawing a gasoline stream from said oligomerization reactor.

The foregoing and other objects and advantages of our invention will appear more fully from the following description, made in connection with the accompanying drawing of the preferred embodiment of the invention.

BRIEF DESCRIPTION OF THE DRAWING

The FIGURE is a process flow sheet schematically illustrating the operation of a FCC cracker, its regenerator, an external catalyst cooler, oligomerization reactor, and its regenerator, which together convert lower alkanes to gasoline.

DETAILED DESCRIPTION OF THE PREFERRED EMBODIMENT

The unique two-stage reactor system converts alkanes to gasoline by utilizing a combination of at least four reaction zones, each utilizing a solid aluminosilicate catalyst. In this combination, the closely tied operation of the third and fourth reaction zones, in each of which a fluid bed is used to carry out the first and second stages, respectively, of the process, determines the economics of the overall process. In the first stage, a large pore FCC catalyst provides the maximum conversion of alkanes to olefins, and in the second stage, a medium pore MOG zeolite catalyst converts the olefins to gasoline range hydrocarbons in an oligomerization reactor, the conversion depending upon the mix of the feedstream.

The effluent from the ECC comprises a mixture of uncoverted alkanes and olefins, mainly ethene, propene, and butenes when a $C_4-$ (alkanes having four C atoms and less) is fed to the ECC. A wide range of $C_2+$ alkanes may be fed to the ECC, typically, an available refinery LPG stream is used. The ECC catalyst, cooled by the endothermic dehydrogenation reaction, is returned to the FCC, either to the FCC regenerator, or to a riser of the FCC cracker. Spent MOG catalyst is regenerated in the MOG regenerator, and returned to the MOG reactor; to maintain activity of the MOG catalyst at a preselected high level, a portion of the spent MOG catalyst is periodically, or continuously discharge from the MOG regenerator. Spent MOG catalyst may be introduced either to the FCC regenerator, or to the riser of the FCC cracker, thus mixing it with the large pore catalyst.

The preferred cracker catalyst consists essentially of large pore crystalline silicate zeolite, generally in a suitable matrix component. Most preferred is a rare earth promoted FCC catalyst in which additional metal promoters, particularly nickel and vanadium, are laid down by the vacuum gas oil (VGO) or resid feed to the FCC riser, and the metals are oxidized in the regenerator. Though the particular cracker catalyst used is not critical to initiate the dehydrogenation reaction, since part of the reaction is due to thermal cracking, the yield and selectivity to olefins is affected by the catalyst type and its metal content. In addition, the FCC catalyst may contain a small amount of Pt, usually less than 300 ppm, to boost the oxidation of CO to $CO_2$ in the regenerator. Since control of the distribution of products from the FCC is much more important than control of the distribution of products obtained by dehydrogenation, the preferred catalyst for our process is the FCC catalyst of choice.

Conventional non-zeolitic FCC catalysts may be used which are generally amorphous silica-alumina and crystalline silica-alumina. Other non-zeolitic materials said to be useful as FCC catalysts are the crystalline silicoaluminophosphates of U.S. Pat. No. 4,440,871 and the crystalline metal aluminophosphates of U.S. Pat. No. 4,567,029.

The most widely used FCC catalysts are large pore crystalline silicate zeolites known to possess some catalytic activity with particular respect to converting lower alkanes to alkenes, at a temperature lower than those at which the regenerator of the FCC unit operates. Such zeolites typically possess an average (major) pore dimension of about 7.0 angstroms and above. Representative crystalline silicate zeolite cracking catalysts of this type include zeolite X (U.S. Pat. No. 2,882,244), zeolite Y (U.S. Pat. No. 3,130,007), zeolite ZK-5 (U.S. Pat. No. 3,247,195), zeolite ZK-4 (U.S. Pat. No. 3,314,752), merely to name a few as well as naturally occurring zeolites, such as chabazite, faujasite, modernite, and the like. Also useful are the silicon-substituted zeolites described in U.S. Pat. No. 4,503,023. Zeolite Beta is yet another large pore crystalline silicate which can constitute a component of the mixed catalyst system herein.

Most preferred is a large pore crystalline aluminosilicate zeolite promoted with a catalytic amount of metal or metal oxide of an element selected from Groups V and VIII of the Periodic Table, sufficient to enhance the dehydrogenation activity of the FCC catalyst.

The term "catalyst" as used herein shall be understood to apply not only to a catalytically active material but to one which is composited with a suitable matrix component which may or may not itself be catalytically active. By "cracker or cracking catalyst" we refer to any catalyst used in a fluid cracker which catalyst has some propane-dehydrogenation activity under the pressure and temperature conditions specified for operation of the ECC.

The FCC cracker is operated under fluidized flow conditions, at a temperature in the range from about 1000° F. to about 1350° F., with a catalyst to charge stock ratio of from about 4:1 to about 20:1, and a contact time of from about 1 to about 20 sec. Generally, it is preferred to crack the charge stock in an upflowing riser conversion zone discharging into cyclonic separation means in an upper portion of an enlarged vessel in which the products of cracking are separated from catalyst.

Preferred charge stocks to the cracker comprise petroleum fractions having an initial boiling point of at least 500° F. (260° C.), a 50% point at least 750° F. (399° C.), and an end point of at least 1100° F. (593° C.). Such fractions include gas oils, thermal oils, residual oils, cycle stocks, whole top crudes, tar sand oils, shale oils, synthetic fuels, heavy hydrocarbon fractions derived from the destructive dehydrogenation of coal, tar, pitches, asphalts, hydrotreated feedstocks derived from anyu of the foregoing, and the like. As will be recognized, the distillation of higher boiling point fractions, above about 750° F. (399° C.) must be carried out under vacuum to avoid thermal cracking. The boiling temperatures utilized herein are expressed, for convenience, in terms of the boiling point corrected to atmospheric pressure.

The separated catalyst is collected in the lower portion of the FCC reactor which is in open communication with the upper end of a downwardly extending stripping zone wherein the catalyst is stripped with countercurrent upwardly flowing stripping gas, such as steam. The stripped products and products of conversion separate from the catalyst and are discharged from the riser conversion zone. They are combined with the cyclonically separated hydrocarbon vapors and passed to one or more downstream zones.

The stripped catalyst is transferred to a regenerator for removal of deposited carbonaceous material by burning, thereby heating the catalyst to a temperature in the range from about 1250° F. (676.7° C.) to about 1500° F. (815.5° C.).

The foregoing steps in the operation of a FCC unit are conventional, being recited hereinabove only to point out that the conditions at which the steps are practiced, are dictated by the charge stock and the product mix desired, which in turn dictates the operation of the regenerator.

Referring now to the drawing, there is schematically illustrated a flowsheet in which a charge stock (feed) 2, such as gas oil (boiling range 600°-1200° F., or 315.5°-676.7° C.) is introduced, after it is preheated, into riser 4, near the bottom. The gas oil is mixed with hot regen catalyst, such as zeolite Y, introduced through a valved conduit means such as standpipe 6 provided with a flow control valve 8. Because the temperature of the hot regenerated catalyst is in the range from about 1200° F. (676.7° C.) to about 1350° F. (732.2° C.), a suspension of hydrocarbon vapors is quickly formed, and flows upward through the riser 4.

The riser 4 is flared gently outward into a region 5 through which catalyst and entrained hydrocarbons are flowed, being afforded, in this region 5, the contact time preselected to provide desired cracked products. Catalyst particles and the gasiform products of conversion continue past region 5 and are discharged from the top of the riser into one or more cyclone separators 14 housed in the upper portion 17 of the vessel, indicated generally by reference numeral 19. Riser 4 terminates in a 'bird cage' discharge device, or an open end "T" connection may be fastened to the riser discharge which is not typically directly connected to the cyclonic catalyst separation means. The effluent from riser 4 comprises catalyst particles and hydrocarbon vapors which are led into the cyclonic separators 14 which effect separation of catalyst from hydrocarbon vapors. Such vapors pass into a plenum chamber 16 and thence are removed through conduit 18 for recovery and further processing. Hydrocarbon vapors from cyclone 14 are discharged to a plenum chamber 16 from which they flow through conduit 18 for further processing and recovery, typically to a fractionator column where the products of cracking are separated into preselected fractions.

Catalyst separated from the vapors descends through dipleg 20 to a fluid bed 22 of catalyst maintained in the lower portion 21 of the vessel 19. The bed 22 lies above, and in open communication with a stripping zone 24 into which the catalyst progresses, generally downward, and countercurrent to upflowing inert gas, usually steam, introduced through conduit 26. Baffles 28 are provided in the stripping zone to improve stripping efficiency.

Spent catalyst, separated from the hydrocarbon vapors in the cyclones, is maintained in the stripping zone 24 for a period of time sufficient to effect a higher temperature desorption of feed-deposited compounds which are then carried overhead by the steam. The stripping zone is maintained at a temperature of about 1250° F. or even higher if hot regenerated catalyst is introduced into the stripping zone by means not shown, as is sometimes done. The steam and desorbed hydrocarbons pass through one or more cyclones 32 which return catalyst fines through dipleg 34 to the bed 22.

Stripped catalyst flows though conduit 36, provided with flow control valve 38, to regenerator 46 containing a dense fluid bed 48 of catalyst into the lower portion of which bed, regeneration gas, typically air, is introduced by distributor 50 supplied by conduit 52. Cyclone separators 54 provided with diplegs 56 separate entrained catalyst particles from flue gas and return the separated catalyst to the fluid bed 48. Flue gases pass from the cyclones into a plenum chamber and are removed therefrom by conduit 58. Hot regenerated catalyst is returned to the bottom of riser 4 by conduit 6, to continue the process with another conversion cycle, all of which is conventionally practiced.

The hot regen catalyst flows though conduit 42, provided with flow control valve 44, to ECC 60 containing a fluid bed 62 of ECC catalyst. As schematically illustrated, the ECC is coupled to the regenerator through the catalyst transfer lines but is physically located externally relative to both the regenerator and the cracker. Into the lower portion of the ECC bed is introduced the ECC feedstream of lower alkanes to be dehydrogenated. Most preferred is a stream in which propane is the major constituent relative to the amount of ethanes and also to the total weight of $C_5+$ hydrocarbon components. The alkane feed is supplied by distributor 64 fed through conduit 66, the ECC feed typically comprising propane, butanes and minor amounts of other lower alkanes, and even smaller amounts of olefins scavenged from various waste refinery streams. The hot stream of regen catalyst withdrawn from the regenerator is quickly cooled by direct contact with the relatively cool gases and catalyst in the ECC bed.

The ECC generally operates at relatively low WHSV in the range from 0.01 to 5.0 $hr^{-1}$, preferably from 0.1 to 1.0 $hr^{-1}$, and in a relatively narrow pressure and temperature range from above 20 psig to about 50 psig (239–446 kPa), preferably 25 psig to about 45 psig (273–411 kPa), and from about 1200° to 1500° F. (649°–815.5° C.), preferably 1350° F. (732° C.), respectively, depending upon the pressure and temperature at which the FCC regenerator is operated.

The amount of heat supplied to the ECC is determined by a controlled amount of catalyst withdrawn from the regenerator. The rate at which the catalyst stream is withdrawn depends upon the temperature at which the regenerator is to be operated, which in turn determines the amount of alkanes which may be dehydrogenated. For a given flow of regenerated catalyst to the ECC at a preselected temperature, and a given rate of lower alkane charged, the temperature of catalyst in the ECC is controlled in the range from about 1100° to 1350° F. (593°–732° C.) by the temperature to which the charge is preheated.

Cyclone separators 68, provided with a dipleg 69, and more preferably sintered metal filters (not shown), separate entrained catalyst particles from ethylene, propylene, hydrogen, butylenes, other hydrocarbon products and unconverted alkanes, and return the separated catalyst to the fluid bed 62. The more efficient the sintered metal filters, the fewer fines transferred to the MOG reactor. The products of conversion of the dehydrogenation reaction pass from the cyclones into a plenum chamber 63 and are removed therefrom by effluent line 65. Relatively cool ECC catalyst is returned to the regenerator 46 through conduit 45 provided with a valve 47, by being lifted with air in the air-lift conduit 52. If desired, the regenerator may be partly or completely bypassed by flowing the cooled catalyst from the ECC through conduit 33, provided with valve 35, to the riser 4. For greater flexibility of operation, a portion of the cooled catalyst from the ECC is returned to the regenerator through line 45, and the remainder flowed through line 33 to the riser.

Regenerated catalyst is removed from the regenerator through return conduit 6 controlled by valve 8, for passage to the riser 4 of the cracker, either above or below the point where line 33 communicates with the riser. This by-passing of the regenerator by directly flowing cooled catalyst from the ECC to the FCC riser is desirable in cases where maximizing catalyst circulation and minimizing thermal cracking because of the relatively low catalyst temperature in the FCC riser, is desired.

Again, for additional flexibility of operation, cooled catalyst from the line 45 may be flowed through conduit 43, controlled by valve 49, into the return conduit 6.

Second Stage: Operation of the MOG Reactor

The olefins which, in the preferred mode of the ECC's operation are predominant in its effluent, may contain up to 45% ethylene, propene, butenes, pentenes, hexenes, and minor amounts of heptenes, octenes, nonenes and their isomers. To this ECC effluent is preferably added a mixture of propene and propane obtained from the FCC column, and the combined streams flowed to the MOG reactor. The partial pressure of the hydrocarbons in the MOG reactor ranges from 2 to 20 atmospheres, preferably from 2 to 5 atm. Almost the entire content of the ECC effluent is desirably upgraded to high octane gasoline containing $C_5{=}+$ aliphatics, preferably $C_8{+}+$ olefins, having a RON octane number of from 93–98. In the best mode, at least 10% by weight, and preferably in excess of 40% by wt of the effluent is converted to a high octane gasoline stream.

The MOG reactor is operable with shape selective medium pore catalysts exemplified by ZSM-5, ZSM-11, ZSM-12, ZSM-23, ZSM-35, ZSM-38, ZSM-48 and other similar materials. U.S. Pat. No. 3,702,886 describing and claiming ZSM-5; U.S. Pat. No. Re. 29,948 describing and claiming a crystalline material with an X-ray diffraction pattern of ZSM-5; and, U.S. Pat. No. 4,061,724 describing a high silica ZSM-5 referred to as "silicalite" are each incorporated by reference thereto as if fully set forth herein. Similarly, the disclosures relating to ZSM-11, ZSM-12, ZSM-23, ZSM-35, ZSM-38, and ZSM-48 set forth in U.S. Pat. Nos. 3,709,979, 3,832,449, 4,076,842, 4,016,245, 4,046,859, and 4,375,573, respectively, are each incorporated by reference thereto as if fully set forth herein.

In general the aluminosilicate zeolites are effectively employed in our second stage MOG reactor. However, zeolites in which some other framework element which is isoelectronic to aluminum and which is present in partial or total substitution of aluminum can be advantageous. For example, m such catalysts may provide a higher conversion of feed to aromatic components, the latter tending to increase the octane, and therefore the quality of the gasoline produced. Specific examples of such catalysts include ZSM-5 and zeolite Beta.

Though the MOG reactor is operable with any of the aluminosilicates, the preferred catalyst is a group of medium pore siliceous materials having similar pore geometry. Most prominent among these intermediate pore size zeolites is ZSM-5, which is usually synthesized with Bronsted acid active sites by incorporating a tetrahedrally coordinated metal, such as Al, Ga, B or Fe, within the zeolitic framework. These medium pore zeolites are favored for acid catalysis; however, the advantages of ZSM-5 type structures may be utilized by employing highly siliceous materials or crystalline metallosilicates having one or more tetrahedral species having varying degrees of acidity. The ZSM-5 crystalline structure is readily recognized by its X-ray diffraction pattern, which is described in U.S. Pat. No. 3,702,886 (Argauer, et al.), incorporated by reference herein.

The oligomerization catalysts preferred for use herein include the medium pore (i.e., about 5–7A) shape-selective crystal-line aluminosilicate zeolites having a silica-to-alumina ratio of at least 12, a constraint index of about 1 to 12 and acid cracking activity of about 10–250. In the fluidized bed reactor the coked catalyst may have an apparent activity (alpha value) of about 10 to 80 under the process conditions to achieve the required degree of reaction severity. Representative of the ZSM-5 type zeolites are ZSM-5, ZSM-11, ZSM-12, ZSM-22, ZSM-23, ZSM-35 and ZSM-38. Details about ZSM-5 are disclosed in U.S. Pat. No. 3,702,886 and U.S. Pat. No. Re. 29,948. Other suitable zeolites are disclosed in U.S. Pat. Nos. 3,709,979; 3,832,449; 4,076,979; 3,832,449; 4,076,842; 4,016,245; 4,046,839; 4,414,423; 4,417,086; 4,517,396 and 4,542,251, incorporated by reference.

While suitable zeolites having a coordinated metal oxide to silica molar ratio of 20:1 to 200:1 or higher may be used, it is advantageous to employ a standard ZSM-5 having a silica alumina molar ratio of about 25:1 to 70:1, suitably modified. A typical zeolite catalyst component having Bronsted acid sites may consist essentially of aluminosilicate ZSM-5 zeolite with 5 to 95 wt. % silica and/or alumina binder.

Certain of the ZSM-5 type medium pore shape selective catalysts are sometimes known as pentasils. In addition to the preferred aluminosilicates, the borosilicate, ferrosilicate and "silicalite" materials may be employed. It is advantageous to employ a standard ZSM-5, suitably modified, having a silica:alumina molar ratio of 25:1 to 70:1 with an apparent alpha value of 10–80 to convert a major portion, preferably at least 60% by weight of the olefins in the feedstock.

ZSM-5 type pentasil zeolites are particularly useful in the process because of their regenerability, long life and stability under the extreme conditions of operation. Usually the zeolite crystals have a crystal size from about 0.01 to over 2 microns or more, with 0.02–1 micron being preferred. In order to obtain the desired particle size for fluidization in the turbulent regime, the zeolite catalyst crystals are bound with a suitable inorganic oxide, such as silica, alumina, etc. to provide a zeolite concentration of about 5 to 95 wt %. In the description of preferred embodiments a 25% HZSM-5 catalyst contained within a silica-alumina matrix and having a fresh alpha value of about 80 is employed unless otherwise stated.

The reaction severity conditions in the ECC are controlled to maximize yield of $C_2$–$C_6$ olefins, and those in the MOG reactor are controlled to maximize gasoline. Accordingly, though only the process conditions can be varied in the ECC because the catalyst in it is the FCC catalyst of choice, an important criterion for an economical process is to select and maintain a catalyst inventory in the MOG reactor to provide either fresh catalyst having the desired alpha (activity), or by controlling catalyst deactivation and regeneration rates of the MOG catalyst so as to provide an apparent average alpha value of about 2 to 50, preferably in the range from 2 to 10.

Reaction temperatures and contact time affect reaction severity. Process conditions in the MOG reactor are chosen to provide substantially steady state conditions wherein the reaction severity index (R.I.) is maintained to yield a desired weight ratio of olefins to alkanes and in particular butane to butenes. Though it appears this index may vary from about 0.01 to 200 in the presence of added propane, it is preferred to operate the steady state fluidized bed unit to hold the R.I. at about 0.02:1 to 5:1. While reaction severity is advantageously expressed as the weight ratio of propane:propene in the gaseous phase, it may also be approximated by the analogous ratios of butanes:butenes, pentane:pentenes, or the average of total reactor effluent alkanes:alkenes in the $C_3$–$C_5$ range. The higher the R.I. value, the higher the conversion for $C_3$, $C_4$ and $C_5$ aliphatics and the overall alkanes:alkenes ratio. These values are in the range from about 0.1 to 20 with a typical $C_3$–$C_5$ olefinic feedstock. The optimum value will depend upon the exact catalyst composition, feedstock and reaction conditions; however, the typical propene-containing light gas mixtures used in the examples herein and similar cracking process off-gas can be optionally upgraded to the desired aliphatics-rich gasoline by keeping the R.I. at about 1.

In a typical reaction system, the fourth reaction zone MOG reactor is provided with a temperature-controlled dense zone of catalyst fluidized around plural heat exchanger coils through which a heat exchange (cooling) fluid is circulated. The coils are preferably spaced apart in a preselected geometry to provide axial and radial mixing, to enhance the back mixing, and to serve as baffles for lowering the effective hydraulic diameter of the reactor. In addition, there may be provided an adjustable gas quench so that one or the other heat exchange means may be used to control the temperature of the bed in the operating range of 600°–950° F. Hot cooling fluid leaving the reactor may be used to preheat feedstock and/or a liquid recycle stream of product in which a major portion of the heavies has been stripped by prefractionation. In addition to the heat exchange means referred to hereinabove, the temperature in the reaction may be controlled by feeding cold feed.

The weight hourly space velocity (WHSV) in the MOG reactor, based on total olefins in the fresh feed stock is in the range from about 0.1 to 20 $hr^{-1}$, preferably in the range from 0.2 to 1 $hr^{-1}$. Spent catalyst to be regenerated is preferably first stripped in a stripper (not shown) with an inert gas, typically steam or nitrogen before being regenerated in the usual way with air under high pressure to fluidize the catalyst. A particular operating economy may be realized with operation of the MOG regenerator and the FCC regenerator at about the same pressure, because the same compressor can beused to provide regen air to each. In the particular case where the MOG reactor operates at a substantially higher pressure, the flow of air from the compressor to the MOG regenerator may be boosted with a smaller booster compressor.

Fines from the effluent of the regenerator are collected in high temperature filters and/or cyclones. To work out details of operation of the reaction system under the pressure and temperature conditions specified is well within the skill of the art and does not require any further description. Catalyst makeup is added from a high pressure catalyst makeup hopper so as to maintain the desired level in the reactor.

Referring further to the drawing for additional details of a typical five-reaction zone system, the effluent 65 from the ECC (third reaction zone) is flowed through feed line 70 to the MOG reactor 71 (the fourth reaction zone) so that the main flow is directed through grid plate 72 into the fluidization zone 73 where the feed gas contacts the turbulent bed of finely divided catalyst particles. The reactor 71 is provided with heat exchange tubes 74 which may be arranged in any suitable configuration to provide baffling for the optimum radial and axial flow of catalyst around the baffles, and temperature control of the catalyst bed. Additional baffles and open-ended downcomer tubes may also be provided as "reactor internals" to control the hydraulics of catalyst flow as disclosed for example in U.S. Pat. No. 4,251,484 to Daviduk et al. The bottoms of the heat exchanger tubes 74 are spaced above the distributor grid 72 sufficiently to be free of jet action by the charged feed through the small diameter holes in the grid. Additionally, the temperature of the bed may be controlled by introducing a cold feed.

Catalyst draw-off pipe 75 is provided for withdrawing catalyst from the bed 73 and flowing it through valve 76 to MOG regenerator 81 (the fifth reaction zone). Partially deactivated MOG catalyst is oxidatively regenerated by controlled contact with air or other regeneration gas at elevated temperature in the MOG regenerator 81 to remove carbonaceous deposits leaving less than 3% coke, and to restore desired catalyst activity. It is preferred to use a small amount of platinum in the catalyst to obtain better burning of coke during regeneration. Desired acid activity (alpha value at equilibrium) is in the range from 2 to 20 with a fines content (40 microns or less) of about 25%.

After regeneration, the catalyst particles are entrained in a lift gas and transported via riser tube 82 to an upper portion of the regenerator 81. Air is distributed at the bottom of the bed 83 through line 84, and the oxidation products are carried out of the regeneration zone through cyclone separators 85 which return solids entrained with the oxidation products. The oxidation products (flue gas) are led away from the regenerator 81 through line 86, and disposed of.

Regenerated MOG catalyst is returned to the MOG reactor 71 through draw-off line 92 provided with flow control valve 93. The regenerated catalyst is lifted into the catalyst bed 73 with pressurized feed gas through catalyst return riser 94. Since the amount of regenerated catalyst returned to the reactor is relatively small, the temperature of the regen catalyst does not upset the temperature constraints of the MOG reactor appreciably. A series of sequentially connected cyclone separators 95, 96 in the upper portion of the reactor 71 are provided with diplegs 95A, 96A to return entrained catalyst fines to the lower portion of bed 73. Filters, such as sintered metal plate filters (not shown), may be used alone or in conjunction with the cyclones, for more efficient separation.

The effluent from the MOG reactor (MOG effluent) leaves through line 97 at elevated pressure in the range from about 100 to about 275 kPa (15 to 40 psia). The MOG effluent is flowed to a "heavies" recovery section and particularly to a prefractionator (not shown) from which olefin-rich overhead is recovered. If desired, a portion may be recycled to the MOG reactor for heat exchange, and addition as a gas, under high pressure.

The regenerator preferably operates at about the same pressure as the reactor. To maintain the activity of the catalyst in the MOG reactor, a portion of the regenerated medium pore MOG catalyst may be withdrawn through line 98 and flowed through control valve 99 to the FCC regenerator 46. If desired it may be flowed to the riser of the FCC reactor, or to the ECC (flow connections now shown). A mixed catalyst system in which a catalyst requiring frequent regeneration, such as zeolite Y, may be employed in combination with a shape selective medium pore crystalline silicate zeolite catalyst requiring comparatively infrequent regeneration such as ZSM-5, as disclosed in copending U.S. patent applications Ser. Nos. 903,311 filed Sept. 3, 1986 by Owen et al, and 060,541 by Avidan et al, filed Nov. 6, 1987, the disclosures of which are incorporated by reference thereto as if fully set forth herein. The preferred "makeup" for catalyst, that is % inventory per day, is in the range from 0.5 to about 1%.

Under optimized process conditions the superficial vapor velocity in the turbulent bed is in the range from about 0.5 to 2 m/sec. At higher velocities entrainment of fine particles maybecome excessive and beyond about 3 m/sec the entire bed may be transported out of the reaction zone. At lower velocities, the formation of large bubbles or gas voids can detrimentally affect conversion.

A convenient measure of turbulent fluidization is the bed density. A typical turbulent bed has an operating density of about 100 to 700 kg/m$^3$, preferably from 200 to 500 kg/m$^3$, measured at the bottom of the reaction zone, become less dense near the top, due to pressure drop and article size differentiation. Pressure differential between two vertically spaced points in the reactor column can be measured to obtain the average bed density in the designated portion of the reaction zone. For example, in a fluidized bed MOG reactor employing ZSM-5 particles having an average density of 2430 kg/m$^3$, an average fluidized bed density of about 300 to 500 kg/m$^3$ is satisfactory.

In the turbulent regime in which the MOG bed operates, the WHSV (based on total catalyst weight) in the range from about 0.1 to 1.0, provides a close control of contact time between vapor and solid phases, typically in the range from 3 to 30 secs; further, the turbulent regime controls bubble size and life span, thus avoiding large scale by-passing of gas in the recator. The turbulent regime extends from the transition velocity to the so-called transport velocity, as described in U.S. Pat. No. 4,547,616 to Avidan et al. As the transport velocity is approached, there is a sharp increase in the rate of particle carryover, and in the absence of solid recycle, the bed could empty quickly.

When employing a ZSM-5 type zeolite catalyst in fine powder form, the zeolite catalyst is suitably bound to, or impregnated on a suitable support with a solid density (weight of a representative individual particle divided by its apparent "outside" volume) in the range from 0.6 to 2 g/cc, preferably 0.9 to 1.6 g/cc.

The catalyst particles can be in a wide range of sizes up to about 250 microns, with an average particle size between 20 and 100 microns, preferably in the range from 10 to 150 microns, and with the average particle size between 40 and 80 microns. The optimum particle size distribution is obtained with a mixture of larger and smaller particles within the afford specified range, having from 10–20% by weight fines. Close control of distribution is maintained with the fines in the size range less than 32 microns. When these catalyst particles are fluidized in a bed where the superficial fluid velocity is 0.2 to 2 m/sec, operation in the turbulent regime is obtained. The average catalyst residence time is preferably in the range from 0.5 to 2 hr, most preferably less than 1 hr. The MOG rector may assume any technically desirable configuration but is at least about 3 and may be as much as 20 meters high, preferably about 8 to 12 meters.

EXAMPLE

6500 BPSD of a lower alkane stream containing propane and n-butane is flowed to the ECC in which a rare earth impregnated type Y large pore cracking catalyst is being cooled by dehydrogenating the stream. The operation pressure of the ECC is about 30 psig (308 kPa) and the bed temperature about 1200° F. (649° C.). We obtain approximately 40% conversion to olefins, the major portion of the propane and butanes being converted. The effluent leaves the ECC at a temperature of about 1200° F.

The effluent from the ECC is combined with 3500 BPSD of a FCC PP stream (75% olefinic), and the combined streams flowed to an MOG reactor with a bed height of about 8 m, operating at a temperature of about 371° C. (700° F.) and pressure of about 240 kPa (20 psig) with a superficial velocity of about 0.4 m/sec.

The catalyst used is a ZSM-5 type catalyst having a fresh alpha value of about 100 and the MOG reactor produces approximately 2800 bbl/day of $C_5$+ gasoline stream with a 92 research octane number (RON), containing predominantly $C_5$–$C_{10}$ hydrocarbons.

Spent MOG catalyst is regenerated in the MOG regenerator operating at a temperature of about 850° F. (454° C.) and a pressure of about 20 psig (240 kPa). The "coke make" on the catalyst is unexpectedly low and the carbon content of the regenerated MOG catalyst is easily maintained at a level below 1% by weight. Contaminants in the olefin effluent from the ECC to the MOG reactor are kept to a minimum because of the adsorption capability of the ECC catalyst for the usual contaminants. The adsorbed contaminants are then readily and conveniently disposed of in the regenerator along with any coke generated in the ECC.

Having thus provided a general discussion, described the dehydrogenation/cracking of an alkane feedstream in the ECC to produce an olefinic effluent which is then oligomerized to a hydrocarbon stream in the gasoline range, and set forth a specific illustration of the present invention in an example in support thereof, it is to be understood that no undue restrictions are to be imposed by reason thereof except as provided by the following claims.

I claim:

1. In a facility for converting alkanes into gasoline, said facility including (A) a fluid catalytic cracking system and (B) an olefin oligomerization reactor, wherein (A) includes a fluid catalytic cracker reactor and first regenerator means in fluid communication therewith for regenerating a coke-contaminated fluid cracking catalyst in a first regeneration zone at a pressure in the range from above 20 psig to about 50 psig and a temperature in the range from about 650° C. to 790° C. (about 1200°–1450° F.) while injecting said first regenerator zone with enough oxygen-containing regeneration gas to maintain a dense fluid bed of cracking catalyst in said first regenerator zone so as to regenerate the catalyst before returning it to said fluid catalytic cracker reactor; and wherein (B) includes an oligomerization reactor containing a medium pore zeolite catalyst effective to oligomerize olefins to gasoline at superatmospheric pressure and temperature in the range from about 315.5° C. to about 538° C. (about 600°–1000° F.) operably connected to a second regenerator means for regenerating a coke-contaminated oligomerization catalyst in a second regeneration zone while injecting said second regenerator zone with enough oxygen-containing regeneration gas to maintain a dense fluid bed of oligomerization catalyst in said second regenerator zone so as to regenerate said oligomerization catalyst before returning it to said oligomerization reactor, said second regenerator means being in valved communication with said oligomerization reactor and defining a second regeneration zone operating at a pressure lower than that in said oligomerization reactor, and a temperature in the range from about 371° C. to about 538° C. (about 700°–1000° F.), the improvement comprising;

a) a first valved conduit means for withdrawing a controlled stream of said regenerated catalyst from said first regenerator means;

b) a dehydrogenation reactor in valved communication with said first regenerator means, through said first valved conduit means said dehydrogenation reactor having a dehydrogenation zone at a temperature below those prevailing in said first regeneration zone, said dehydrogenation reactor being located externally relative to said fluid catalytic cracker reactor and first regenerator;

c) means for introducing a lower alkane feedstream into said dehydrogenation zone in an amount sufficient to maintain hot withdrawn catalyst in a state of fluidization in said dehydrogenation reactor while said catalyst is being cooled therein;

d) a second valved conduit means for transporting cooled catalyst from said dehydrogenation zone to said first regeneration zone;

e) a third conduit means for withdrawing an olefinic effluent stream from said dehydrogenation reactor and directing said effluent to said oligomerization reactor;

f) a fourth valved conduit means for transporting regenerated oligomerization catalyst from said second regeneration means to said oligomerization reactor; and g) a fifth conduit means for withdrawing a gasoline stream from said oligomerization reactor.

2. An integrated reactor system for the production of gasoline boiling range hydrocarbons from feedstreams comprising alkanes and gas oil range hydrocarbons, comprising in combination;

a) fluid catalytic cracking (FCC) reactor means for conversion of said gas oil to a portion of said gasoline boiling range hydrocarbons;

b) FCC catalyst regenerator means for regenerating catalyst from said FCC reactor, said FCC catalyst regenerator means operably connected to said FCC reactor means to receive spent catalyst therefrom and return regenerated catalyst thereto;

c) fluid catalytic dehydrogenation reactor means for dehydrogenation of said alkane feedstream at a temperature below that of said FCC catalyst regenerator means to produce alkene effluent product stream, said dehydrogenation reactor operably connected to and in communication with said FCC reactor means and said FCC catalyst regenerator means for i) transfering a portion of cooled dehydrogenation catalyst to said FCC reactor, ii) transfering spent dehydrogenation catalyst to said FCC catalyst regenerator means for catalyst regeneration, and iii) receiving regenerated dehydrogenation catalyst from said FCC catalyst regenerator;

d) fluid bed oligomerization catalyst reactor means, operably connected to receive said alkene effluent product stream, for conversion of said alkene stream from said dehydrogenation reactor means to a second portion of said gasoline boiling range hydrocarbons including oligomerization catalyst regenerator means operably connected to said oligomerization reactor means to regenerate catalyst therefrom.

* * * * *

UNITED STATES PATENT AND TRADEMARK OFFICE

CERTIFICATE OF CORRECTION

PATENT NO. : 5,049,360

DATED : Sept. 17, 1991

INVENTOR(S) : Harandi et al.

It is certified that error appears in the above-identified patent and that said Letters Patent is hereby corrected as shown below:

Column 14 (Claim 2) line 56, insert "from said dehydrogenation reaction means" after "stream"

Column 14 (Claim 2) line 57, delete "from said dehydrogenation reactor means"

Signed and Sealed this

Fourth Day of May, 1993

*Attest:*

Michael K. Kirk

MICHAEL K. KIRK

*Attesting Officer*

*Acting Commissioner of Patents and Trademarks*